United States Patent [19]

Gross et al.

[11] Patent Number: 4,893,602

[45] Date of Patent: Jan. 16, 1990

[54] PROCESS FOR FUEL METERING

[75] Inventors: Helmut Gross, Gerlingen; Wolfgang Höptner, Uhingen; Günther Kaiser, Stuttgart, all of Fed. Rep. of Germany

[73] Assignee: Robert Bosch GmbH, Stuttgart, Fed. Rep. of Germany

[21] Appl. No.: 165,274

[22] PCT Filed: Jun. 23, 1987

[86] PCT No.: PCT/DE87/00283

§ 371 Date: Mar. 2, 1988

§ 102(e) Date: Mar. 2, 1988

[87] PCT Pub. No.: WO88/00285

PCT Pub. Date: Jan. 14, 1988

[30] Foreign Application Priority Data

Jul. 9, 1986 [DE] Fed. Rep. of Germany ..... 3623041

[51] Int. Cl.[4] ..... F02D 41/10; F02D 41/34

[52] U.S. Cl. ..... 123/492

[58] Field of Search ..... 123/490, 492

[56] References Cited

U.S. PATENT DOCUMENTS

| | | | |
|---|---|---|---|
| 4,463,732 | 8/1984 | Isobe et al. | 123/492 |
| 4,508,085 | 4/1985 | Yamato | 123/492 |
| 4,620,519 | 11/1986 | Nagao et al. | 123/492 |
| 4,697,568 | 10/1987 | Yasuoka | 123/490 |
| 4,723,524 | 2/1988 | Atago et al. | 123/492 |

FOREIGN PATENT DOCUMENTS

| | | | |
|---|---|---|---|
| 162334 | 9/1984 | Japan | 123/492 |
| 203840 | 11/1984 | Japan | 123/492 |
| 98144 | 6/1985 | Japan | 123/492 |

*Primary Examiner*—Tony M. Argenbright

*Attorney, Agent, or Firm*—Michael J. Striker

[57] ABSTRACT

The invention relates to a process for fuel metering during acceleration operations at a plurality of cylinders of an internal-combustion engine, with sequential injection, in which the fuel quantity to be injected is determined corresponding to the operating state and the acceleration state is determined, additional fuel injections being performed after determination of the acceleration state. Such a process is to be further developed to the extent that a faster metering of the increased fuel quantity into the internal-combustion engine can be performed during the acceleration operation. To achieve this object, it is proposed that the determined fuel quantity is injected into at least one, preferably into all those cylinders whose injected fuel quantity has not yet been taken in and whose inlet valve has not yet been closed or whose intake stroke has not yet been concluded. This takes place in particular at the time of the generation of a trigger signal (TS) corresponding to the quantity which corresponds to the set fuel increase of the acceleration.

3 Claims, 1 Drawing Sheet

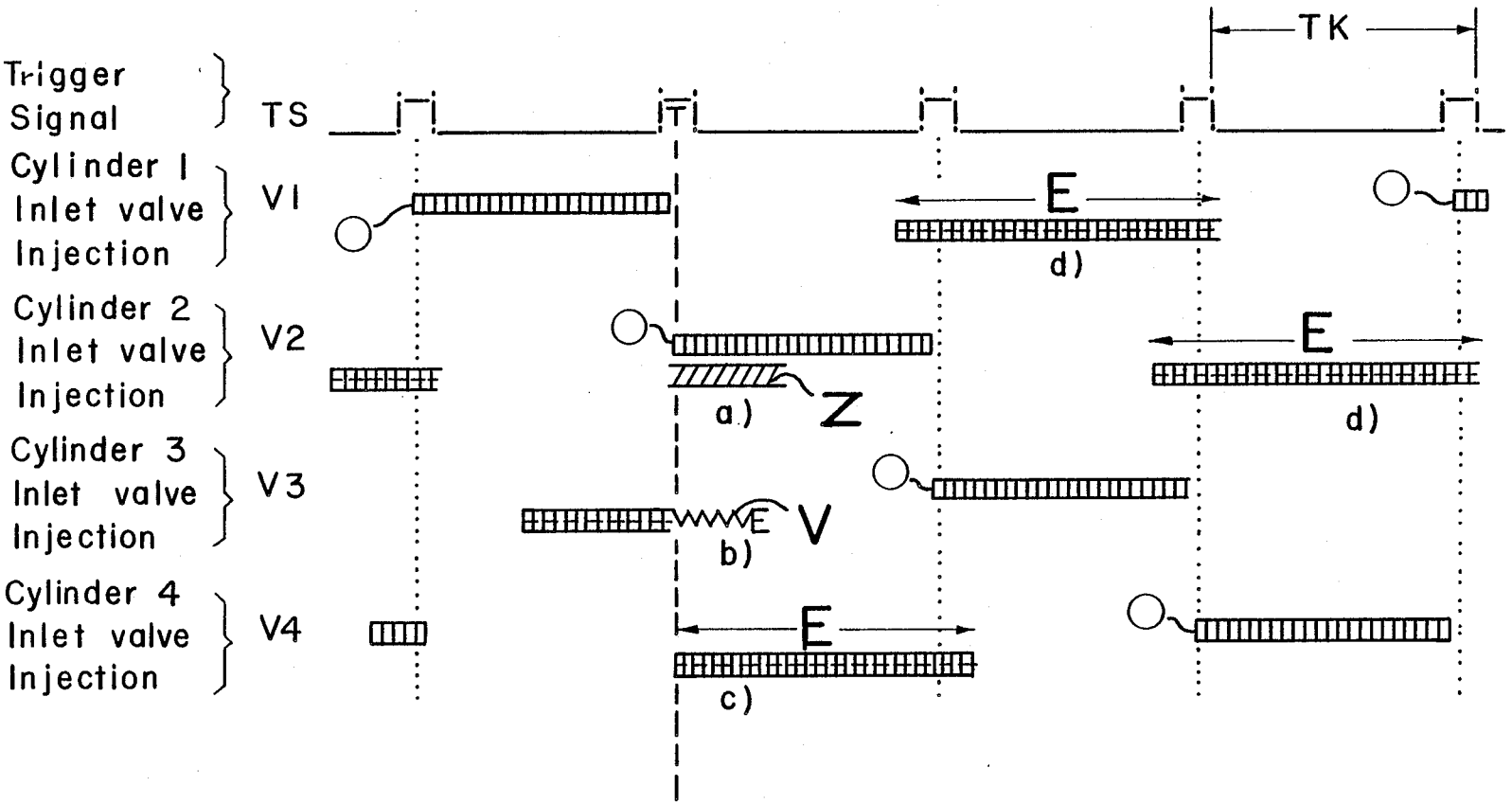
Trigger Signal
TS
Cylinder 1
Inlet valve
V1
Injection
Cylinder 2
Inlet valve
V2
Injection
Cylinder 3
Inlet valve
V3
Injection
Cylinder 4
Inlet valve
V4
Injection
TK
E
d)
E
d)
Z
a)
V
b)
E
c)

PROCESS FOR FUEL METERING

PRIOR ART

The invention relates to a process for fuel metering during acceleration operations, and, more particularly, for metering fuel during acceleration into a plurality of cylinders of an internal combustion engine, with sequential injection.

From German Offenlegungsschrift No. 3,418,387, a process for fuel metering to a plurality of cylinders of an internal-combustion engine, with sequential injection upon acceleration, is described. The quantity of the fuel supplied to the engine is set to a value suitable for the operating state determined, in each case based on the generation of a trigger signal, and the sequential injections of the fuel quantity thus set are effected in a predetermined sequence synchronously with the trigger signal. Upon detection of the acceleration state, an additional fuel injection is carried out during a trigger signal. If a fuel increase is established at the time of the generation of an instantaneous trigger signal, the additional injection of the set fuel increase is performed into the cylinder into which one of the sequential injections was performed during the previous trigger signal. The fuel increase of the acceleration is preferably set to the value which corresponds to the difference between a fuel injection quantity set at the time of the generation of the instantaneous trigger signal and a fuel injection quantity supplied during a previous trigger signal. The fuel injections take place synchronously with and always at the same times as the generation of the pulse of a trigger signal. An adaptation to the operating state does not take place.

SUMMARY OF THE INVENTION

The process according to the invention for fuel metering during acceleration operations has in comparison the advantage that a direct and fast metering of the fuel quantity corresponding to the acceleration state takes place. With the detection of the acceleration state and the new calculation or new establishment of the fuel quantity, the difference in quantity from the fuel quantity determined in the previous operating cycle is determined. This extra quantity is supplied to the cylinders whose regular fuel injection has been commenced but whose intake stroke has not yet been concluded. This takes place on the one hand in the form of additional fuel injections at cylinders whose fuel metering has been concluded or else by prolongation of fuel injection in progress by the extra quantity calculated. Furthermore, the injection valves for all fuel injections whose commencement has been brought back in time by the newly calculated fuel quantity are immediately opened. During the acceleration operation, particular importance is thus attributed to a fast metering of the increased fuel quantity; according to the invention, this takes place with priority over the ending of a fuel injection preset by the angle of advance. The sequential injections of the set quantity of fuel take place in a predetermined sequence at a time dependent on the operating state of the internal-combustion engine, within the operating cycle preset by the trigger signal. Additional fuel injections are performed, to be precise into all those cylinders whose injected fuel quantity still has not been taken in and whose inlet valve has not yet been closed. The fuel injections already in progress at the moment that additional fuel injections are performed are increased by the necessary extra quantity. Furthermore, the fuel injections whose commencement was still in the future before detection of the acceleration state are expediently commenced earlier than stationary or else immediately in order to ensure the ending of the injection operation still before the closing of the inlet valve.

DRAWING

The process according to the invention is illustrated in the drawing and is explained in more detail in the following description. The drawing shows a time history of the fuel metering after detection of an acceleration state.

DESCRIPTION OF THE INVENTION

The drawing is based on an internal-combustion engine with four cylinders, the trigger signals TS being represented in the top line. This trigger signal TS is advanced by an application-specific angle with respect to the top dead centres of the individual cylinders. The time period TK corresponds to a crankshaft rotation of 180°. For each of the cylinders 1 to 4, the opening times of the inlet valves V1 to V4 are represented and the corresponding duration of an injection by the injection valve is given by E. The operating state of the internal-combustion engine is detected synchronously with the trigger signal TS. The definition of the acceleration state is undertaken on the basis of the current operating state and the data of previous operating states, the load, load changes, speed etc. being detected in particular. Once the acceleration state has been defined and established in the way not to be explained any further here, during the acceleration state of the internal-combustion engine, the fuel metering is increased by an extra quantity adapted to the respective acceleration state. According to the invention, the metering takes place for all the cylinders whose regular fuel metering has been commenced and whose intake operation has not yet been concluded, i.e. the inlet valve is not yet closed. In the following it is assumed that the acceleration state is detected at the time t.

Just after this time t, the inlet valve V2 of cylinder 2 is opened. Due to the detected acceleration state, an additional fuel injection, known as an intermediate jet Z, takes place immediately into the cylinder 2. In the next operating cycle, then the scheduled fuel injection, adapted to the new load, takes place again into the same cylinder and is represented by the opening of the inlet valve being indicated by O. Within the scope of this invention, the commencement of the scheduled sequential fuel injection takes place corresponding to the fuel quantity, the battery voltage, the angle of advance and the speed. The angle of advance in this case determines the position of the end of the sequential injection with respect to the opening of the associated inlet valve. After each trigger signal, the fuel injection to be triggered is initiated within the following operating cycle.

In cylinder 3, the fuel injection would, in itself, be over shortly after the time t. Due to the detected acceleration state, however, the fuel injection still in progress into the cylinder 3 is prolonged. The total prolonged fuel injection in cylinder 3 is indicated by V in the drawing. Due to this prolongation, according to the invention, of the fuel injection, an increased fuel quantity is therefore available without delay.

Finally, the next fuel injection is commenced immediately in cylinder 4 and is indicated by the signal c. For this cylinder 4, normally, that is without the acceleration state having been detected and without the process according to the invention coming into effect, the injection would not have commenced until a later instant. Due to the represented immediate commencement of the fuel injection, according to the invention a fast metering of the fuel quantity corresponding to the acceleration state takes place.

An essential point here is that the newly calculated fuel quantity at the time t is decisive for all fuel injections whose injection commencement has to be initiated at or after this trigger signal TS and for all cylinders at which the scheduled injection has already been concluded but whose inlet valve is still open.

What is claimed is:

1. A process for metering fuel into a plurality of cylinders of an internal combustion engine during acceleration operations, said cylinders having a plurality of intake valves for said fuel, comprising the steps of determining an operating state; injecting a fuel quantity corresponding to said operating state so determined; determining an acceleration state; establishing an additional fuel quantity associated with said acceleration state; injecting said additional fuel quantity of said acceleration state after determining said acceleration state; delivering said additional fuel quantity after determining said acceleration state to at least one of said cylinders having an open intake valve; prolonging said injecting of said fuel quantity corresponding to said operating state of at least one other of said cylinders in which said injecting has not been concluded when said acceleration state has been determined; and immediately injecting in another of said cylinders when said acceleration state has been detected said fuel amount determined in correspondence with said operating state that was to be injected at a future time.

2. The process according to claim 1 further comprising opening at least one of said intake valves of said cylinders after determining said acceleration state.

3. The process according to claim 1 wherein said additional fuel quantity is injected in all of said cylinders in which said fuel quantity determined in correspondence with said operating state has been commenced but has not yet been concluded.

* * * * *